United States Patent [19]

Besnia

[11] Patent Number: 4,968,458

[45] Date of Patent: Nov. 6, 1990

[54] FUEL ATOMIZATION DEVICE

[76] Inventor: Keith A. Besnia, Water St., Granville, Mass. 01034

[21] Appl. No.: 439,145

[22] Filed: Nov. 20, 1989

[51] Int. Cl.[5] ..... F02M 29/04
[52] U.S. Cl. ..... 261/78.1; 261/DIG. 39
[58] Field of Search ..... 261/78.1, DIG. 39

[56] References Cited

U.S. PATENT DOCUMENTS

| | | | |
|---|---|---|---|
| 2,152,057 | 3/1939 | Killmeyer et al. | 261/DIG. 39 |
| 2,996,290 | 8/1961 | Munden | 261/78.1 |
| 4,171,332 | 10/1979 | Gohnert | 261/DIG. 39 |
| 4,375,438 | 3/1983 | McKay | 261/78.1 |
| 4,427,604 | 1/1984 | Pawelski | 261/78.1 |
| 4,673,536 | 6/1987 | Morris | 261/DIG. 39 |

FOREIGN PATENT DOCUMENTS

| | | | |
|---|---|---|---|
| 529746 | 9/1921 | France | 261/DIG. 39 |
| 1008178 | 2/1952 | France | 261/78.1 |
| 1261377 | 4/1961 | France | 261/78.1 |
| 2053363 | 2/1981 | United Kingdom | 261/78.1 |

*Primary Examiner*—Tim Miles
*Attorney, Agent, or Firm*—Leon Gilden

[57] ABSTRACT

A device is set forth positioned in alignment with a fuel delivery system associated within a carburetor, wherein an atomization cylinder formed of a fine mesh cylindrical metallic screen is positioned orthogonally relative to a venturi opening diameter spaced below a venturi input opening and above the associated venturi output opening. The mesh screen includes a cylindrical configuration mounted within a cylindrical recess formed in diametrical alignment with a fuel conduit directed into the venturi wherein fuel atomization is enhanced in directing annular discharge of fuel into the venturi.

1 Claim, 3 Drawing Sheets

FIG 2
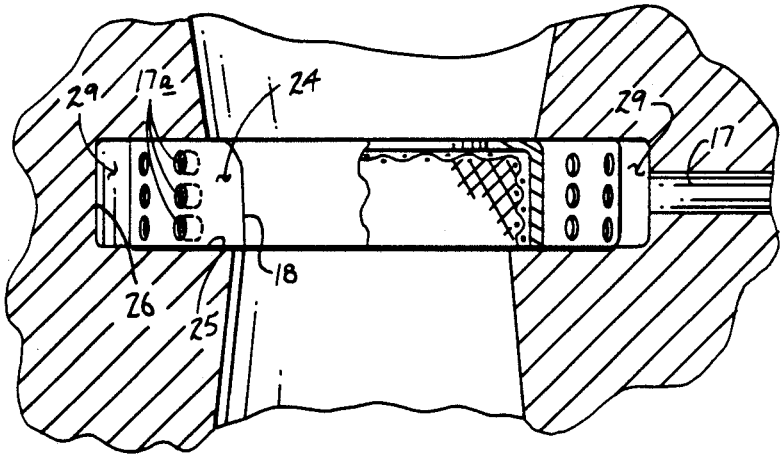
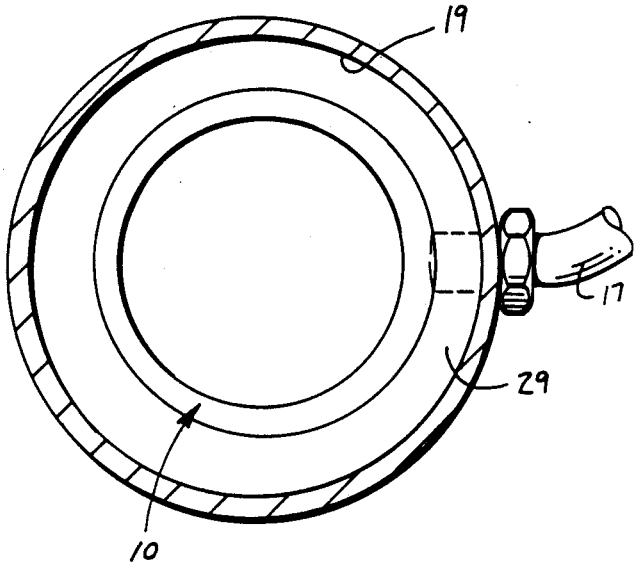
FIG 5

FUEL ATOMIZATION DEVICE

BACKGROUND OF THE INVENTION

1. Field of the Invention

The field of invention relates to carburetion devices, and more particularly pertains to a new and improved fuel atomization device for use in combination with a carburetor to enhance atomization of fuel in association with air flow into the carburetor to enhance combustion efficiency.

2. Description of the Prior Art

Various carburetion devices and means to enhance fuel atomization is known in the prior art and are used in an attempt to provide a finer dispersion of the fuel in combination with air flow, wherein enhanced homogeneous mixture of air and fuel is noted for the associated combustion efficiency associated therewith. Examples of the prior art include U.S. Pat. No. 4,171,332 to Gohnert wherein a mesh screen portion is formed within a solid delivery tube positioned adjacent a venturi of a carburetor to enhance atomization of the fuel.

U.S. Pat. No. 4,091,786 to Hartopp sets forth a flow regulating device for use in combination with a carburetor wherein the device includes a metal gauze sheet overlying a fuel-air mixture to enhance atomization of the mixture.

U.S. Pat. No. 4,336,104 to Miller sets forth a fuel system wherein an atomizer is arranged overlying an air intake portion of a carburetor wherein the atomized fuel is directly injected to an intake throat of manifolding associated with an internal combustion engine.

U.S. Pat. No. 3,544,290 to Larson sets forth a fuel atomization unit arranged for insertion in the duct connecting the carburetor to the intake manifold, wherein a vane resonator and propeller vibrate to generate vibrations to enhance dispersion of the fuel within an air mixture.

U.S. Pat. No. 4,088,103 to Brown sets forth a grid positioned within an inlet manifold positioned below a carburetor to enhance fuel atomization from the carburetor to the internal combustion engine.

As such, it may be appareciated that there is a continuing need for a new and improved fuel atomization device wherein the same adresses the problems of fuel atomization as well as economy of application and efficiency of its use in association with the carburetor and in this respect, the present invention substantially fulfills this need.

SUMMARY OF THE INVENTION

In view of the foregoing disadvantages inherent in the known types of fuel atomization devices now present in the prior art, the present invention provides a fuel atomization device wherein the same sets forth a cylindrical delivery tube positioned within a venturi to enhance atomization of fuel directed therethrough. As such, the general purpose of the present invention, which will be described subsequently in greater detail, is to provide a new and improved fuel atomization device which has all the advantages of the prior art fuel atomization devices and none of the disadvantages.

To attain this, a device is set forth positioned in alignment within a venturi in communication with a fuel delivery system associated within a carburetor. An atomization screen cylinder is formed of a fine mesh metallic screen whose axis is mounted parallel relative to a venturi restriction spaced below a venturi input opening and above the associated venturi output. The mesh screen is of a cylindrical configuration mounted and within an annular recess at a narrowed portion of the venturi. A modified screen includes an annular apertured dispenser cover overlying an exterior annular surface of the screen to enhance fuel delivery through the screen.

My invention resides not in any one of these features per se, but rather in the particular combination of all of them herein disclosed and claimed and it is distinguished from the prior art in this particular combination of all of its structures for the functions specified. There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fuel atomization device which has all the advantages of the prior art fuel atomization devices and none of the disadvantages.

It is another object of the present invention to provide a new and improved fuel atomization device which may be easily and efficiently manufactured and marketed.

It is a further object of the present invention to provide a new and improved fuel atomization device which is of a durable and reliable construction.

An even further object of the present invention is to provide a new and improved fuel atomization device which is susceptible of a low cost of manufacture with regard to both materials and labor, and which accordingly is then susceptible of low prices of sale to the consuming public, thereby making such fuel atomization devices economically available to the buying public.

Still yet another object of the present invention is to provide a new and improved fuel atomization device which provides in the apparatuses and methods of the prior art some of the advantages thereof, while simultaneously overcoming some of the disadvantages normally associated therewith.

Still another object of the present invention is to provide a new and improved fuel atomization device wherein the same is positioned within a venturi portion of a carburetor and rigidly within an annular recess diametrically within a narrowed portion of the venturi in communication with fuel delivery to enhance fuel atomization in association with a volumetric flow of air directed through the venturi.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross-sectional view of the invention mounted in a carburetor venturi.

FIG. 5 is a top orthographic view of the instant invention in association with a carburetor venturi subsequent to its mounting therewithin.

DESCRIPTION OF THE PREFERRED EMBODIMENT

With reference now to the drawings, and in particular to FIGS. 1 to 5 thereof, a new and improved fuel atomization device embodying the principles and concepts of the present invention and generally designated by the reference nemerals 10 and 10*a* will be described.

Figure 1A:
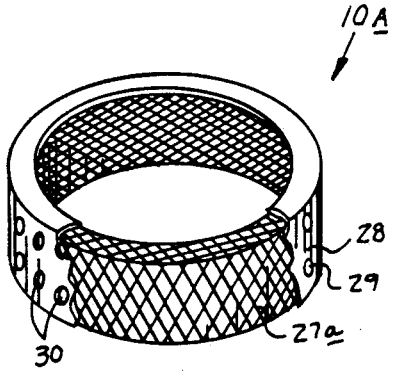
FIG. 1*a* is an isometric illustration of a modification of the instant invention.
Figure 1:
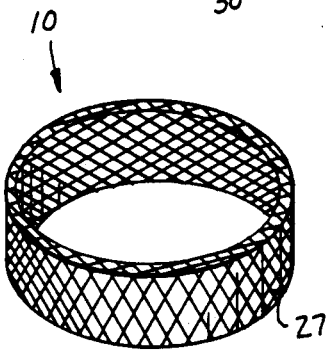
FIG. 1 is an isometric illustration of the instant invention.
Figure 4:
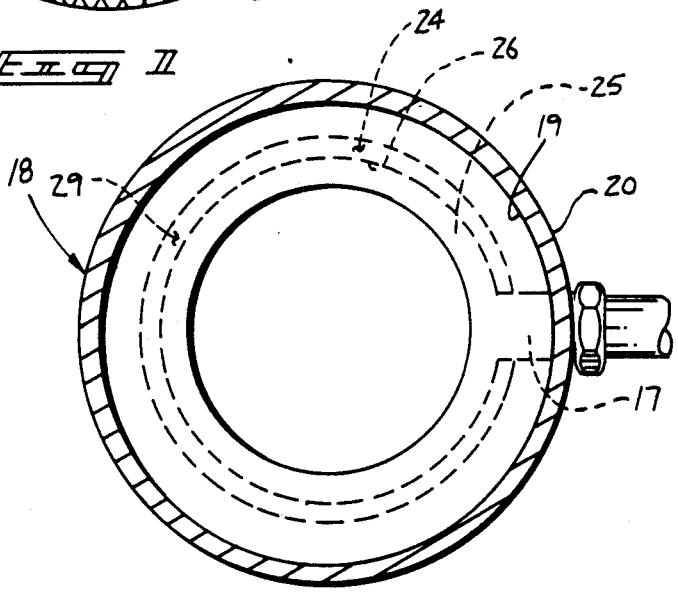
FIG. 4 is a bottom orthographic view of the invention in association with a carburetor venturi.
Figure 3:
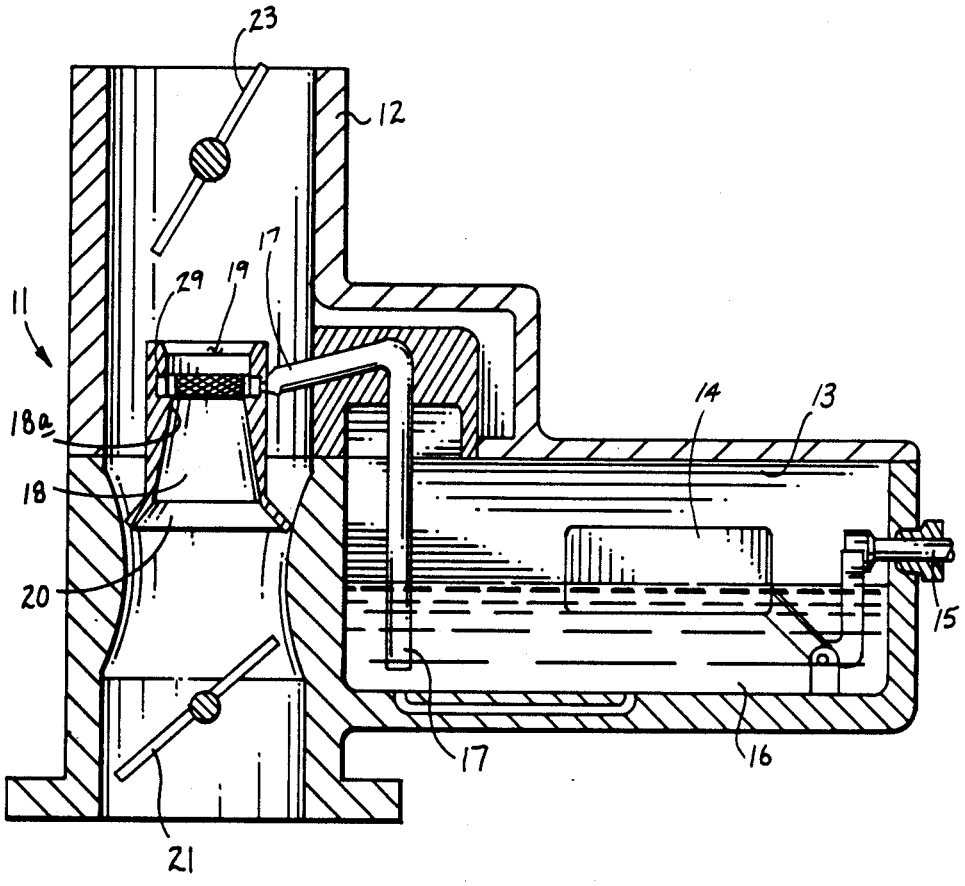
FIG. 3 is an orthographic cross-sectional view of the instant invention in association with a carburetor.

More specifically, the fuel atomization device 10 comprises a combination in association with a carburetor assembly 11. The carburetor assembly 11 includes a throttle body 12 oriented for directing a volumetric direction of air flow therethrough and directing a fuel-air mixture to the engine in the direction of the arrow 22. The cover assembly further includes a fuel bowl 13 positioned adjacent the throttle body 12 wherein a float valve 14 receives fuel from a fuel inlet 15 to position fuel within the fuel reservoir 16. A fuel delivery tube 17 is directed from the fuel reservoir 16 and directs the fuel in association with a venturi 18, wherein fuel is atomized in conjunction with fuel delivery into the air stream in an annular delivery from the fuel delivery tube through annular discharge conduits 17*a*. The venturi 18 is defined by a generally truncated conical configuration with an inlet diameter substantially less than an outlet diameter, wherein the venturi inlet 19 is positioned coaxially aligned and defines an opening spaced above and parallel to the venturi outlet 20. A throttle plate 21 is pivotally mounted in association with conventional carburetor linkage to govern the quantity of fuel-air mixture directed to the internal combustion engine, with a conventional choke plate 23 pivotally mounted overlying the venturi 18 to limit air flow therethrough to enhance start up and richen the air fuel mixture directed to the internal combustion engine associated with the carburetor 11. The fuel atomization device 10 is positioned and mounted coaxially relative to the axis of the venturi 18 and is positioned in a venturi throat diameter 18*a* in alignment with the fuel delivery tube 17 and annular feed slot 30 directed to the venturi 18 to direct fuel in an annular array into the venturi 18*a*. The organization further removal an annular interior portion of the venturi at 18*a*, or at the narrowest portion of the venturi, aligned with the annular discharge orifices 17*a*. An annular milling cut is performed at the narrowest portion of the venturi to define and form a bottom annular ledge 25 and an annular wall 26. The atomization device 10 comprises an annular fine mesh screen defined by a diameter substantially equal to a diameter defined by the annular cylindrical wall 26, wherein the annular mesh screen 27 is of a screen width to equal the width of the ledge 25, whereupon the thusly milled cavity 24 securely receives the screen 10. FIG. 1*a* illustrates a modified atomization device 10*a* defined by a modified scren 27*a* that includes a fuel dispersion covering 28 which includes a matrix of spaced apertures 30 therethrough to impede fuel flow from the annular recess or fuel delivery channel 29 providing fuel from the fuel delivery tube to the annular screen 27 or 27*a*. The fuel dispersion covering 28 is configured to cover the exterior annular surface of the modified screen 27*a*, as well as the top and bottom edges thereof, to force direction of fuel through the apertures 30 and then through the screen 27*a* to thereby enhance atomization of fuel entering the venturi. The atomization device 10*a* is illustrated in position in FIG. 2 subsequent to the aforenoted milling procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fuel atomization device in combination with a carburetor, wherein the carburetor includes an elongated air flow throttle body with a venturi conduit defined by a conduit axis mounted within the throttle body overlying a pivotally mounted throttle plate, and the venturi conduit including an inlet opening spaced above an outlet opening, and a fuel reservoir with a fuel delivery tube directing fuel from the fuel reservoir to the venturi below the inlet opening, and an annular fuel recess positioned within the venturi in fluid communication with the fuel delivery tube, and an annular fuel atomization means mounted adjacent the annular fuel recess for enhanced atomization of fuel in association with air flow directed through the throttle body, and wherein the fuel atomization means extends coaxially relative to the conduit axis of the venturi conduit and includes an annular mesh screen, and wherein the annular fuel recess includes an annular ledge and an annular wall receiving the annular mesh screen, and wherein the annular wall is defined by a predetermined height equal to a predetermined height defined by the annular mesh screen, and wherein the mesh screen includes a fuel dispersion covering overlying an exterior annular surface of the mesh screen and defined by a height equal to the predetermined height, and an upper and lower edge thereof, and wherein the covering is impermeable, and the covering includes a matrix of apertures therethrough to direct fluid communication to the annular atomization screen to direct fuel flow through the annular fuel recess, through the apertures, and through the annular mesh screen to be atomized for mixture with air flow directed through the venturi conduit, the covering spaced from the annular wall and mounted on the annular ledge to define an annular channel between the annular wall and the covering.

* * * * *